US005529435A

United States Patent [19]

Sonntag et al.

[11] Patent Number: 5,529,435

[45] Date of Patent: Jun. 25, 1996

[54] INTERNAL VIBRATOR

[75] Inventors: Gerd Sonntag, Monheim; Alfred Eichleitner, Riemerling, both of Germany

[73] Assignee: Heilit + Woerner Bau-AG, Munich, Germany

[21] Appl. No.: 329,018

[22] Filed: Oct. 25, 1994

[30] Foreign Application Priority Data

Oct. 27, 1993 [DE] Germany ..... 9316430 U

[51] Int. Cl.[6] ..... E04G 21/08

[52] U.S. Cl. ..... 404/115; 404/116; 366/128

[58] Field of Search ..... 404/97, 118, 113, 404/114, 115, 116, 133.05, 133.1; 366/108, 117, 122, 123, 128; 74/87

[56] References Cited

U.S. PATENT DOCUMENTS

| | | | |
|---|---|---|---|
| 1,459,841 | 6/1923 | Mitchell | 74/87 |
| 2,278,839 | 4/1942 | Douglass | 366/123 |
| 2,289,248 | 7/1942 | Davis | 94/24 |
| 2,750,160 | 6/1956 | Englund et al. | 74/87 |
| 3,784,168 | 1/1974 | Schneider et al. | 366/123 X |
| 4,650,366 | 3/1987 | Morrison | 404/114 |

FOREIGN PATENT DOCUMENTS

| | | |
|---|---|---|
| 675169 | 5/1966 | Belgium . |

*Primary Examiner*—David J. Bagnell
*Assistant Examiner*—James A. Lisehora
*Attorney, Agent, or Firm*—Anderson Kill Olick & Oshinsky

[57] ABSTRACT

An internal vibrator comprises a vibrator pipe, attached a transverse pipe transversely to the vibrator pipe at a bottom end region thereof, a vibrator drive, and an imbalance driven by the vibrator drive, wherein the vibrator drive and the imbalance are disposed in the transverse pipe.

23 Claims, 3 Drawing Sheets

INTERNAL VIBRATOR

FIELD OF THE INVENTION

The present invention is directed to an internal vibrator, especially for concrete which has not been hardened.

BACKGROUND OF THE INVENTION

Internal vibrators are known and used to fluidize and consolidate freshly poured concrete layers by high frequency vibrations generated by the internal vibrator. In conventional internal vibrators, the vibrator drive and the imbalance, driven by the vibrator drive, are disposed in the vibrator pipe, which normally is completely immersed into the still liquid concrete layer. The vibrator drive and all support points of the imbalance are thus cooled by the concrete surrounding the external wall of the vibrator pipe, when the internal vibrator is in operation. Overheating of the vibrator drive and of the support of the imbalance are practically impossible.

A transverse pipe is fastened at the bottom end of the vibrator by welding, for better transmission of the high frequency vibration into the concrete, produced by rotation of the imbalance. This transverse pipe increases the effective vibration surface and thus the efficiency of the vibrator, so that the vibrating period necessary for setting of the concrete is noticeably reduced. If however the concrete layer is built up in the course of a two-layer construction process with a bottom concrete layer and subsequently with a concrete layer, the internal vibrators are permitted to dip only into the concrete layer. If the vibrators are immersed also into the bottom concrete layer, there exists the danger that dowels provided in the bottom concrete layer sink excessively towards the bottom and thus do not strengthen the bottom concrete layer in a suitable manner. Furthermore, the two concrete layers would be intermixed with one another in an undesirable manner.

For this reason, conventional vibrators are immersed only with the tip of their vibrators into the concrete layer in the course of the two-layer construction processes and the region of the vibrator pipe containing the vibrator drive is exposed to the atmosphere. In such procedures, high failure rates of the vibrator motor was experienced. The reasons for this can be overheating of the vibrator drive or increased corrosion of the internal vibrator in operation and during subsequent stoppage because of the high temperature differences occurring in the vibrator.

It is therefore an object of the present invention to provide an internal vibrator, where sufficient cooling of the vibrator drive is assured, even with small immersion depth of the internal vibrator into the concrete.

SUMMARY OF THE INVENTION

This and other objects of the invention, which shall become hereafter apparent, is achieved by arranging the vibrator drive and the imbalance in the transverse pipe. By this arrangement, even with small immersion depths of the internal vibrator into the liquid concrete, which as mentioned above, is required in case of two-layer construction use, the heat produced by the vibrator drive and in the bearings of the imbalance can be dissipated by the fluidized concrete surrounding the transverse pipe and the vibrator pipe. Damage to the internal vibrator or the vibrator drive by overheating and by the successive intense heating during operation and cooling after operation resulting intensified corrosion can be avoided. This, in turn, avoids downtime or replacement time before or during the vibrator operation, so that the concrete layer can be vibrated or shaken rapidly and uniformly, without being impaired by failures of the internal vibrator.

The vibrator drive preferably comprises an electromotor, with a stator disposed essentially in the central region of the transverse pipe and a rotor embraced by the starer and rigidly connected to a motor shaft. Thus, it is assured that the heat generated by the electromotor can be dissipated equally towards both sides of the transverse pipe. Furthermore, transverse forces generated by the unsymmetrical construction of the internal vibrator are avoided.

If the stator comprises a stator core, as well as a stator winding and if it rests at the transverse pipe contacting the same completely with its external circumferential surface, firm fitting of the stator in the transverse pipe and thus optimal utilization of the space in the transverse pipe is assured. Thus, the stator core cannot vibrate relative to the transverse pipe.

The space available in the transverse pipe for the motor or the motor shaft is optimally utilized because the motor shaft extends essentially to an equal extent on both sides of the rotor and is disposed parallel to the transverse pipe in such a way that the ends of the motor shaft are essentially located in the region of the end of the transverse pipe.

The motor shaft may be supported on both sides of the rotor in the transverse pipe in order to maintain the motor shaft, as well as the rotor inside of the stator essentially free of vibration and thus avoid vibrations of the motor shaft generated by the rotation of the imbalance. If the imbalance is divided, wherein one part of the imbalance is disposed at one end of the motor shaft, respectively, the vibration energy produced by the rotation of the imbalance is transmitted optimally to the entire length of the transverse pipe, so that the internal vibrator exhibits a high efficiency. Furthermore, the symmetrical construction with respect to a longitudinal axis of the vibrator pipe assures that transverse forces occurring during operation of the internal vibrator can be avoided so that stretching or stressing of the internal vibrator by such transverse forces can be eliminated.

Preferably, each portion of the imbalance comprises a plurality of individual imbalance elements which are attached at the respective end of the motor shaft to be removable or whose angle is to be adjustable for selective change of the angle of the imbalance and/or of the mass of the imbalance. Thus, the vibration energy generated by the internal vibrator can be adapted to the respective requirements, by changing the mass of the imbalance. Furthermore, it is possible to change the natural frequency of the vibration system by changing the mass of the imbalance, so that the vibration frequency of the internal vibrator can be adapted to the respective requirements, with minimal expenditure of energy.

If removable and preferably unscrewable sealing caps are disposed at the ends of the transverse pipe, the attachment or removal or adjustment of the imbalance elements in the region of the ends of the transverse pipe can be preformed in a particularly simple and rapid manner. In addition, access to the internal space of the transverse pipe is obtained by removing the sealing caps, so that possible repairs or cleaning operations can be easily performed.

An essentially annular lateral projection (extending away from the transverse pipe) disposed in the central region of the transverse pipe fastens the transverse pipe in a simple manner to the vibrator pipe. A circumferential flange is disposed in the region of the bottom end of the vibrator pipe, at which an end face of the lateral projection rests in the assembled state of the internal vibrator and the transverse pipe is retained at the vibrator pipe by threaded bolts penetrating through the circumferential flange. Thus, a stable attachment of the transverse pipe at the vibrator pipe is assured enabling replacement of the transverse pipe, for, for instance, performing maintenance or cleaning work.

A quick attachment of the transverse pipe at the vibration pipe is possible by having a segment of the vibration pipe formed between the bottom end of the vibration pipe and the circumferential flange protrude into an aperture formed by the side or lateral extension or projection, wherein the external diameter of the segment is only slightly smaller than the internal diameter of the aperture. Thus, the vibrator pipe is merely inserted into the aperture in the lateral projection or extension and turned sideways until the appropriate bores for the threaded bolts in the circumferential flange and in the side extension register. Further, the segment of the vibrator pipe extending into the aperture stabilizes the connection between the vibrator pipe and the transverse pipe.

In order to obtain access from the vibration pipe to the transverse pipe, a side aperture in the transverse pipe essentially registering with the aperture of the annularly shaped extension can be provided.

Preferably a current supply line runs through the vibrator pipe and the side aperture in the transverse pipe, so that no additional apertures have to be provided in the vibrator pipe or the transverse pipe, through which current supply lines would have to be run into the appropriate pipes. Moisture penetration through such additional apertures can thus be avoided.

If recesses for laying current lines to the respective stator windings are provided at the external circumferential surface of the stator, the necessary current lines can be laid in a simple manner to the appropriate windings and, at the same time, be protected in the appropriate recesses against the action of external forces.

Alternatively, the current carrying lines can be disposed in recesses provided at the internal circumferential surface of the transverse pipe for laying current lines to the respective stator windings.

In order to assure quick disconnecting of current carrying lines from the current supply line when replacing a transverse pipe, the current carrying line may be connected by a plug-in connection, with the current supply line running through the vibrator pipe. Thus, one can avoid using clipped or soldered connections so that replacement or removal of a transverse pipe, together with the integrated vibrator drive, is greatly simplified.

If the portion of the plug-in connection jointed to the current supply line is disposed at the bottom end of the vibrator pipe and if the portion of the plug-in connection connected to the current carrying lines is fastened at the transverse pipe in the region of the side apertures, this assures that the plug-in connection is established automatically during the attachment process at the vibrator pipe. Thus, no additional manipulations for disconnecting or establishing the plug-in connection are required. Additionally, the vibrator pipe is already inserted in the correct installation position into the transverse pipe during the attachment process of the transverse pipe at the vibrator pipe because the plug-in connection components are already fixed at the transverse pipe or the vibrator pipe. Thus, the apertures provided, for instance at the circumferential flange of the vibrator pipe and in the side extension of the transverse pipe for the threaded bolts already register and the assembly process is additionally facilitated.

BRIEF DESCRIPTION OF THE DRAWINGS

The invention will be better understood by the detailed description of the preferred and alternate embodiments, with reference to the drawings, in which.

DETAILED DESCRIPTION OF THE PREFERRED AND ALTERNATE EMBODIMENTS

Figure 1:
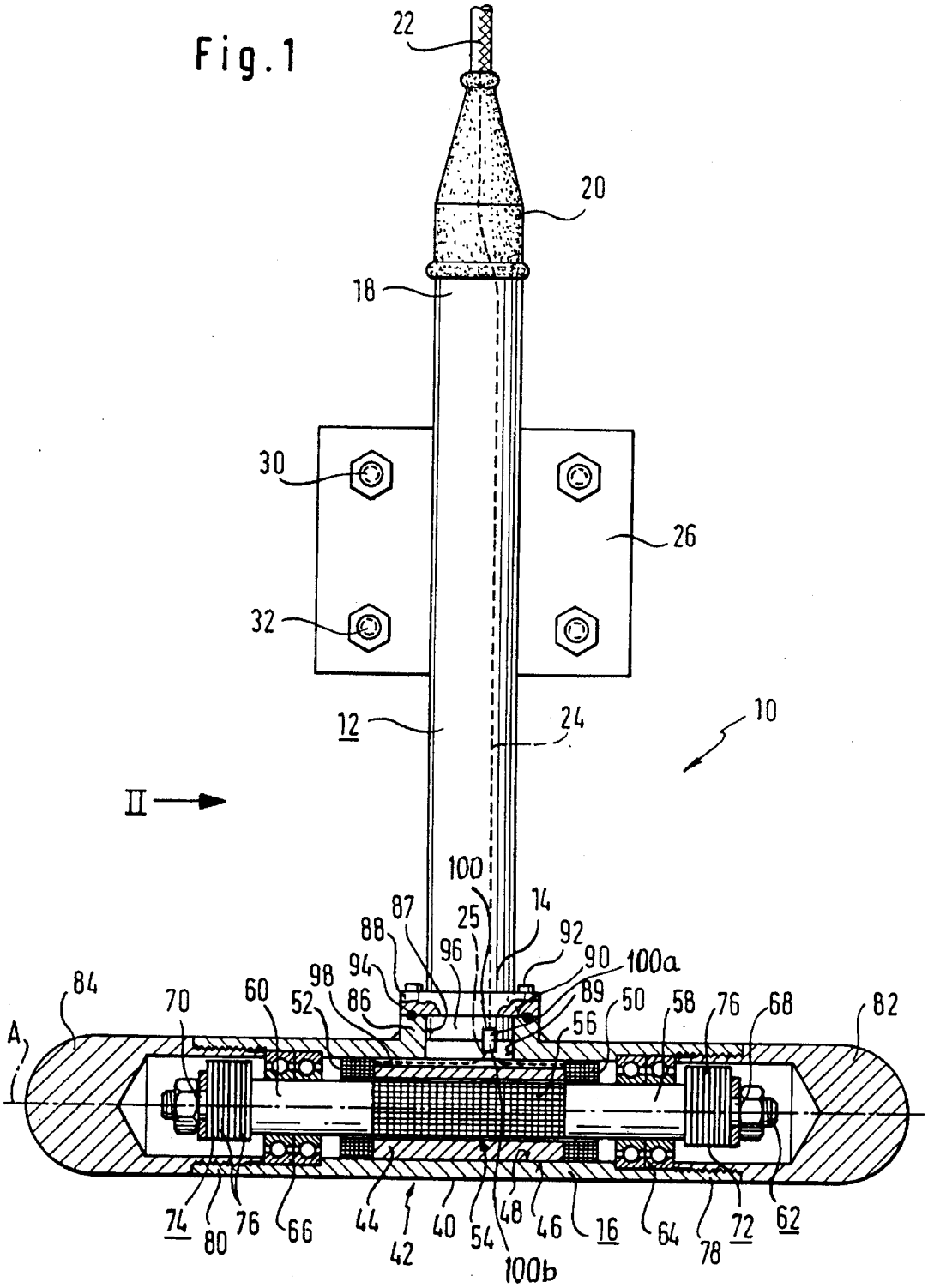
FIG. 1 is a front and partially cross-sectional view of the internal vibrator of the invention.
Figure 2:
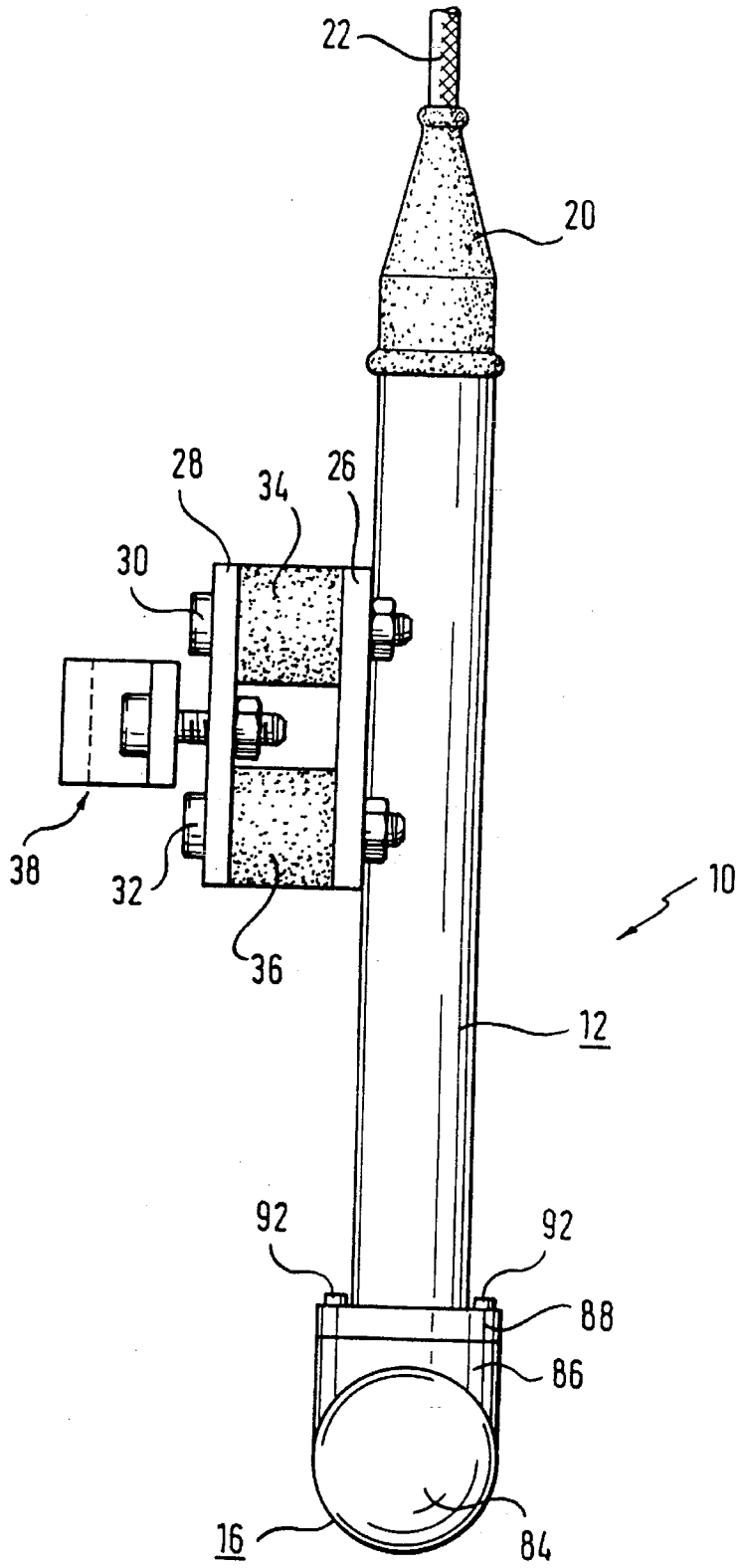
FIG. 2 is a side view of the internal vibrator shown in FIG. 1, viewed in direction of arrow II in FIG. 1.

Referring now to the drawings, wherein like numerals depict like elements, throughout the views, an internal vibrator is shown in FIG. 1 and 2 and is generally designated by the numeral 10. The internal vibrator 10 comprises a vibrator pipe 12 and a transverse pipe 16 attached in the region of the bottom end 14 of the vibrator pipe 12. A current carrying cable 22 is introduced into the vibrator pipe 12, for instance through an elastic cuff 20, in the region of the upper end 18 of the vibrator pipe 12. The current carrying cable 22 runs through the vibrator pipe 12 and forms the current supply line 24 (shown in FIG. 1 as a dotted line) for driving the internal vibrator 10, as described in more detail as follows.

An attachment plate 26 is fastened, for instance, by welding or the like, to the vibrator pipe 12. A matching plate 28 is retained by bolts 30 and 32 at the plate 26, with interposition of elastic elements 34 and 36. A retaining device 38 can be fastened to the matching plate 28, by which retaining device 38 the internal vibrator 10 can, for instance, be attached to a concrete layer maker, or finisher (not shown here).

The vibrator drive 42 is disposed in the central region 40 of the transverse pipe 16. The vibrator drive 42 comprises an essentially cylindrical stator 44, which rests tightly at the internal surface 48 of the transverse pipe 16, with its entire external circumferential surface 46. Stator windings 50 or 52 are provided on both sides of the stator 44. A rotor 54, with a rotor winding 56, is disposed in the cylindrical cavity of the stator 44 and rotates around an axis of rotation A. The alternating current (or direct current if a commutator is provided) is directed through the stator windings 50 and 52 and generates currents and a magnetic field in the rotor winding 56 interacting alternately with the magnetic field of the stator windings 50 and 52.

Segments 58 and 60 of a motor shaft 62 extend on both sides of the rotor 54. The motor shaft 62 is rotatably supported in the transverse pipe 16 in the region of the segments 58 and 60 on bearings 64 and 66.

Imbalance parts 72 or 74 are disposed at the ends of the motor shaft 62, meaning the ends 68 and 70 of the shaft segments 58 and 60. The imbalance parts 72 and 74 can, for instance, be fixed by bolts or bolt-like end segments of the shaft segments 58 or 60 at the motor shaft 62 to be removable or angularly adjustable.

As can be seen in FIG. 1, each imbalance part 72, 74 comprises a plurality of individual imbalance elements 76. The two imbalance parts 72 and 74 are disposed in such a way in the transverse pipe 16, that they are located in the region of the ends 78, 80 of said transverse pipe 16. Sealing caps 82 and 84 are arranged at these respective ends 78, 80 of the transverse pipe 16. The sealing caps 82, 84 seal the transverse pipe 16 tightly, so no concrete or other liquids can penetrate inside or can, for instance, be threaded onto the transverse pipe by threads at the sealing caps 82, 84 and at the ends 78, 80 of the transverse pipe 16.

The sealing caps 82 and 84 can be unscrewed from the transverse pipe 16 for replacing the imbalance parts 72, 74, or for removing or adding individual imbalance elements 76. Thus it is possible to adopt, in a simple manner, the mass of the imbalance and thus the vibration energy produced by the vibrator or the vibration frequency of the internal vibrator 10 to the requirement defined by the respective type of concrete.

A lateral cylindrical extension 86 for attaching the transverse pipe 16 to the vibrator pipe 12 is disposed in the central segment 40 of the transverse pipe 16. Furthermore, a circumferential flange 88 is provided in the region of the bottom end 14 of the vibrator pipe 12, which, in the assembled state of the internal vibrator 10, comes to rest at an end face 90 of the extension 86. Bores (not shown) are provided in the circumferential flange 88, which are penetrated by threaded bolts 92, which engage into bores provided in the extension 86, for instance, into the threaded bores (not shown), thus retaining the transverse pipe 16 at the vibrator pipe 12. Matching circumferential grooves are provided in the end face 90 of the extension 86 or the corresponding end face of the circumferential flange 88. The grooves receive an o-ring like sealing element 94. Thus, the connection between the vibrator pipe 12 and the transverse pipe 16 is protected against penetration of the concrete or liquid into the vibrator pipe 12 or the transverse pipe 16.

A segment 96 of the vibrator pipe 12, extending beyond the circumferential flange 88, protrudes into the aperture 87 formed in the extension 86. Herein, the vibrator pipe 12 has an external diameter in the region of the segment 96, which is only slightly smaller than the internal diameter of the extension 86. Thus, the vibrator pipe 12, with the segment 96, can simply be inserted into the extension 86 of the transverse pipe 16 in the course of assembly of the internal vibrator 10. Thereupon, the vibrator pipe 12 or the transverse pipe 16 needs to be turned only until the bores provided in the circumferential flange 88 register with the bores in the extension 86.

The cable supply line 24, running through the vibrator pipe 12, extends through the segment 96 of the vibrator pipe 12 and through an aperture formed in the transverse pipe corresponding to the aperture 87 in the extension 86, into the inside of the transverse pipe 16. Herein, the current supply line 24 branches out, as shown in dotted lines in FIG. 1, into several current carrying lines 25 which are conducted to the individual stator windings 50 or 52.

To insure that the stator 44 comes to rest with its entire external circumferential surface 46 against the internal surface 48 of the transverse pipe 16, a recess 98 is provided in the external circumferential surface 46 of the stator core 44 for each of the current carrying lines running to the windings 50 or 52. The current carrying lines 25, can thus be conducted to the windings 50 or 52, without being jammed between the stator 44 and the transverse pipe 16 being, at the same time, secured in the recesses 98 against sliding sideways.

Plug-in connection elements 100 can be disposed at the vibrator pipe 12 or transverse pipe 16 in the region of the end segment 96 of the vibrator pipe 12 or in the region of the aperture 89 in the transverse pipe 16. The plug-in connection elements include a first portion **100*a*, connected to the current supply line 24 and fastened to a bottom end of the vibrator pipe 12, and a second portion 100*b* fastened to the transverse pipe 16. This establishes a plug-in connection during assembly of the internal vibrator 10—that is, upon introduction of the segment 96 into the aperture 87 between the current supply line 24 and the current carrying lines 25, leading to the stator windings and enables establishing the electrical connection of the vibrator drive 42, with the current supply line 24 in a simple manner and fixes the position of the transverse pipe 16 to the vibrator pipe 12 already during insertion of the vibrator pipe 12 into the aperture 87. Thus, a subsequent turning of the transverse pipe 16 or the vibrator pipe 12 for positioning the bores for the threaded bolts 92** is no longer necessary.

Figure 3:
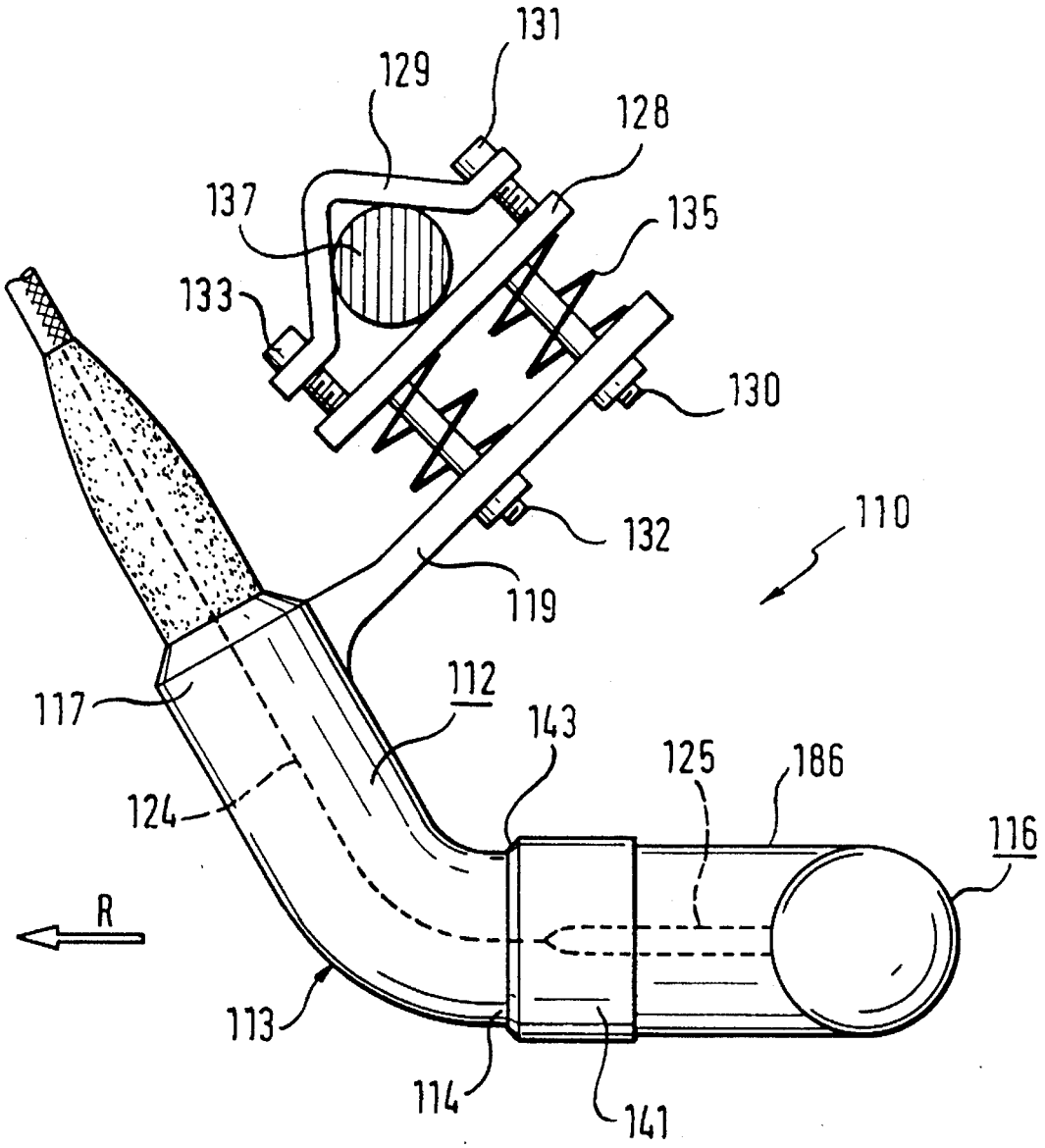
FIG. 3 is a front view of an alternative embodiment of the internal vibrator of the invention, corresponding to FIG. 2.

FIG. 3 depicts an alternate embodiment of the internal vibrator. In this embodiment, parts corresponding to the parts shown in FIGS. 1 and 2 of the first embodiment form are designated with the same reference numbers increased by 100.

In this embodiment, vibrator pipe 112 has a curve in a region 113, in such a way that the segment of the vibrator pipe 112 connected to the transverse pipe 116 in a state of the internal vibrator 110, assembled, for instance, at the concrete layer, extends counter to a direction of motion R of the concrete layer maker or the internal vibrator. Thus, the side forces acting upon the vibrator pipe 112 are clearly reduced during the course of the forward movements of the internal vibrator 110 through the concrete layer. The stress on the attachment elements of the internal vibrator 112 is also reduced. Finally, the overall vibrator surface immersed into the concrete layer increases correspondingly, thereby increasing also the vibrator effectiveness.

In the embodiment depicted in FIG. 3, a side or lateral arm 119 is provided in the region of the top end 117 of the vibrator pipe 112, for attaching the internal vibrator 110 to, for instance, a concrete layer. A matching plate 128 is fixed by threaded studs 130 and 132 to the lateral arm 119, with interposition of coil spring elements 135. The matching plate 128 is fixed by a clamping plate 129 and threaded bolts 131, 133 to a rod element 137, rigidly connected to a concrete layer.

By disposition of the spring elements 135, the lateral arm 119 and the internal vibrator 110 can be pivoted during force effects with respect to a matching plate 128 fixed to a concrete layer maker, so that damage such as bending of the side arm or the vibrator pipe during operation of the internal vibrator 110 is avoided.

In this embodiment, the transverse pipe 116 is connected to the vibrator pipe 112 by a threaded sleeve 141. The lateral extension 186 has an external thread at its free end, which engages with an internal thread provided at the sleeve 141. The circumferential flange (not shown), provided at the vibrator pipe 112, is clamped between an end segment 143 of the sleeve 141 having a smaller diameter corresponding to the external diameter of the vibrator pipe 112 and an end face (not shown) of the extension 186, so that the transverse pipe 116 is retained tightly at the vibrator pipe 112.

In this embodiment, the current supply line 124 or the current carrying lines 125 are also conducted inside of the vibrator pipe 112 or of the transverse pipe and plug-in connections (not shown), can be disposed in the lateral extension 186 or in the vibrator pipe 112, establishing the electrical connection automatically between the current supply line 124 and the current carrying lines 125 leading to the stator windings. Thus, the internal vibrator of the invention is particularly suitable for types of operation in the course of which the internal vibrator cannot be immersed into the concrete layer beyond a specific depth. In order still to assure an adequate dissipation of the heat produced by the vibrator drive, the vibrator drive and the imbalance are located in the transverse pipe, disposed at the lower end of the vibrator pipe. Damage by overheating of the internal vibrator in the course of operation are thus avoided because the heat generated is dissipated into the concrete surrounding the transverse pipe.

In addition, the actual effective surface of the internal vibrator, increased by the transverse pipe is optimally utilized, since mechanical vibrations necessary for vibrating the concrete are generated and transmitted directly inside of the transverse pipe and, in particular, at the end segments of said transverse pipe.

It is possible to remove the transverse pipe, for instance, for maintenance work very quickly from the vibrator pipe or to install a replacement transverse pipe quickly and in a simple manner at the vibrator pipe by a particularly simple type of attachment of the transverse pipe at the vibrator pipe and by an electrical plug-in connection for the current supply line to the vibrator drive.

Sealing caps which can be unscrewed from the ends of the transverse pipe provide a simple access to the individual imbalance parts so that the imbalance mass or the imbalance angle can be easily varied and thus adapted to the circumstances defined by the special operational conditions.

While the preferred and alternate embodiments of the invention have been depicted in detail, modifications and adaptations may be made thereto, without departing from the spirit and scope of the invention, as delineated in the following claims.

What is claimed is:

1. An internal vibrator, comprising:

a vibrator pipe having a bottom end region;

a transerve pipe attached substantially transversely to the vibrator pipe at the bottom end region thereof;

imbalance means located in the transverse pipe; and a vibrator drive located in the transverse pipe for driving the imbalance means, the vibrator drive comprising an electric motor including a rotor, a shaft rigidly connected with the rotor, and a stator disposed in a central region of the transverse pipe and embracing the rotor, the stator having a stator core and at least one stator winding defining, together with the stator core, an external circumferential surface of the stator resting, with substantially entire surface area thereof against an inner surface of the transverse pipe;

wherein the transverse pipe has, in a central region thereof, a substantially annularly shaped lateral extension, and the vibrator pipe has, in the bottom end region thereof, a circumferential flange against which an end face of the lateral extension of the transverse pipe rests, the internal vibrator further comprising threaded bolts extending through the circumferential flange for retaining the vibrator and transverse pipes together, and the vibrator pipe has a segment protruding beyond the circumferential flange and into an aperture formed in the lateral extension of the transverse pipe, the segment having an external diameteral which is only slightly smaller than an internal diameter of the aperture.

2. An internal vibrator, comprising:

a vibrator pipe having a bottom end region;

a transverse pipe attached substantially transversely to the vibrator pipe at the bottom end region thereof;

imbalance means located in the transverse pipe; and a vibrator drive located in the transverse pipe for driving the imbalance means, wherein the transverse pipe has, in a central region thereof, a substantially annularly shaped lateral extension, and the vibrator pipe has, in the bottom end region thereof, a circumferential flange against which an end face of the lateral extension of the transverse pipe rests, the internal vibrator further comprising threaded bolts extending through the circumferential flange for retaining the vibrator and transverse pipes together, and the vibrator pipe has a segment protruding beyond the circumferential flange and into an aperture formed in the lateral extension of the transverse pipe the segment having an external diameter which is only slightly smaller than an internal diameter of the aperture.

3. The internal vibrator of claim 2, wherein the transverse pipe has a lateral aperture essentially registering with an aperture of the annularly shaped extension.

4. The internal vibrator of claim 3, further comprising a current supply line running through the vibrator pipe and the lateral aperture in the transverse pipe.

5. The internal vibrator of claim 4, wherein the vibrator drive comprises an electric motor having a stator with stator windings provided in an external circumferential surface of the stator, the transverse pipe having recesses for receiving current carrying lines for supplying electric current to the stator windings.

6. The internal vibrator of claim 5, wherein the recesses for current carrying lines are provided in an internal circumferential surface of the transverse pipe.

7. The internal vibrator of claim 5, further comprising a plug-in connection for connecting the current carrying lines with the current supply line.

8. The internal vibrator of the claim 7, wherein a portion of the plug-in connection connected to the current supply line is fastened at a bottom end of the vibrator pipe, and a portion of the plug-in connection connected to the current carrying lines is fastened in the transverse pipe in a region of the lateral aperture so that the plug-in connection is established automatically when attaching the transverse pipe to the vibrator pipe.

9. An internal vibrator, comprising:

a vibrator pipe having a bottom end region;

a transverse pipe attached substantially transversely to the vibrator pipe at the bottom end region thereof;

imbalance means located in the transverse pipe; and a vibrator drive located in the transverse pipe for driving the imbalance means and having a shaft extending in the transverse pipe;

wherein the shaft has opposite end portions projecting from opposite ends of a central region of the transverse pipe, and the imbalance means comprises a plurality of separate imbalance elements supported at the opposite ends of the shaft, the internal vibrator further including means for removable fastening the separate imbalance elements at the opposite ends of the shaft so that at least one of an imbalance angle and an imbalance mass can be selectively changed.

10. The internal vibrator of claim 9, wherein the vibrator drive comprises an electric motor having a stator disposed essentially in the central region of the transverse pipe; and a rotor embraced by the stator and rigidly connected to the vibrator drive shaft.

11. The internal vibrator of claim 10, wherein the stator comprises a stator core and at least one stator winding defining, together with the stator core, an external circumferential surface of the stator resting against an inner surface of the transverse pipe.

12. The internal vibrator of claim 10, wherein the shaft is disposed parallel to a longitudinal extent of the transverse pipe, and the end portions of the motor shaft lie in regions of the ends of the transverse pipe.

13. The internal vibrator of claim 12, wherein the motor shaft is supported in the transverse pipe on both sides of the rotor.

14. The internal vibrator of claim 9, further comprising removable sealing caps disposed at the end portions of the transverse pipe.

15. The internal vibrator of claim 14, wherein the sealing caps are formed as unscrewable sealing caps.

16. The internal vibrator of claim 9, wherein the transverse pipe has, in a central region thereof, a substantially annularly shaped lateral extension, and the vibrator pipe has, in the bottom end region thereof, a circumferential flange against which an end face of the lateral extension of the transverse pipe rests, the internal vibrator further comprising threaded bolts extending through the circumferential flange for retaining the vibrator and transverse pipes together.

17. The internal vibrator of claim 16, wherein the vibrator pipe has a segment protruding beyond the circumferential flange and into an aperture formed in the lateral extension of the transverse pipe, the segment having an external diameter which is only slightly smaller than an internal diameter of the aperture.

18. The internal vibrator of claim 16, wherein the transverse pipe has a lateral aperture essentially registering with an aperture of the annularly shaped extension.

19. The internal vibrator of claim 18, further comprising a current supply line running through the vibrator pipe and the lateral aperture in the transverse pipe.

20. The internal vibrator of claim 19, wherein the vibrator drive comprises an electric motor having a stator with stator windings provided in an external circumferential surface of the stator, the transverse pipe having recesses for receiving current carrying lines for supplying electric current to the stator windings.

21. The internal vibrator of claim 20, wherein the recesses for current carrying lines are provided in an internal circumferential surface of the transverse pipe.

22. The internal vibrator of claim 20, further comprising a plug-in connection for connecting the current carrying lines with the current supply line.

23. The internal vibrator of the claim 22, wherein a portion of the plug-in connection connected to the current supply line is fastened at a bottom end of the vibrator pipe, and a portion of the plug-in connection connected to the current carrying lines is fastened in the transverse pipe in a region of the lateral aperture so that the plug-in connection is established automatically when attaching the transverse pipe to the vibrator pipe.

* * * * *